US007202202B2

(12) United States Patent
Haeggberg et al.

(10) Patent No.: US 7,202,202 B2
(45) Date of Patent: Apr. 10, 2007

(54) CONSUMABLE DETERGENT COMPOSITION FOR USE IN A LIPOPHILIC FLUID

(75) Inventors: Donna Jean Haeggberg, Cincinnati, OH (US); John Christian Haught, West Chester, OH (US); Kelli Alison Fleisch, Cincinnati, OH (US); William Michael Scheper, Lawrenceburg, IN (US); Keith Homer Baker, West Chester, OH (US); Robb Richard Gardner, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 136 days.

(21) Appl. No.: 10/873,976

(22) Filed: Jun. 22, 2004

(65) Prior Publication Data

US 2005/0009723 A1 Jan. 13, 2005

Related U.S. Application Data

(60) Provisional application No. 60/483,345, filed on Jun. 27, 2003.

(51) Int. Cl.
*C11D 9/36* (2006.01)
*C11D 1/66* (2006.01)
*C11D 1/04* (2006.01)

(52) U.S. Cl. ..... 510/285; 510/289; 510/304; 510/356; 510/377; 510/389; 510/407; 510/413; 510/422; 510/421; 510/427; 510/430; 510/437; 510/466

(58) Field of Classification Search ..... 510/285, 510/289, 304, 356, 377, 389, 407, 413, 422, 510/421, 427, 430, 437, 466
See application file for complete search history.

(56) References Cited

U.S. PATENT DOCUMENTS

| | | | | |
|---|---|---|---|---|
| 2,787,596 | A | 4/1957 | Stewart et al. | |
| 3,370,330 | A | 2/1968 | Sieber | |
| 3,658,575 | A | 4/1972 | Tabor et al. | |
| 3,771,955 | A | 11/1973 | Jones | |
| 3,784,355 | A | 1/1974 | Fielding | |
| 3,953,381 | A | 4/1976 | Remond et al. | |
| 4,097,397 | A | 6/1978 | Mizutani et al. | |
| 4,102,824 | A | 7/1978 | Mizutani et al. | |
| 4,124,517 | A | 11/1978 | Hisamoto et al. | |
| 4,639,321 | A | 1/1987 | Barrat et al. | |
| 4,685,930 | A | 8/1987 | Kasprzak et al. | |
| 4,708,807 | A | 11/1987 | Kemerer et al. | |
| 4,824,602 | A * | 4/1989 | Juneja | 510/122 |
| 4,911,853 | A | 3/1990 | Coffindaffer et al. | |
| 5,002,686 | A * | 3/1991 | Guth et al. | 510/339 |
| 5,057,240 | A | 10/1991 | Madore et al. | |
| 5,133,897 | A | 7/1992 | Balzer | |
| 5,273,684 | A * | 12/1993 | Traber et al. | 516/199 |
| 5,482,703 | A * | 1/1996 | Pings | 424/70.12 |
| 5,540,853 | A * | 7/1996 | Trinh et al. | 510/101 |
| 5,547,918 | A * | 8/1996 | Newton et al. | 504/361 |
| 5,705,562 | A | 1/1998 | Hill et al. | |
| 5,707,613 | A | 1/1998 | Hill et al. | |
| 5,741,760 | A * | 4/1998 | Mondin et al. | 510/365 |
| 5,865,851 | A | 2/1999 | Sidoti et al. | |
| 5,865,852 | A | 2/1999 | Berndt et al. | |
| 5,876,510 | A | 3/1999 | Kuemin et al. | |
| 5,888,250 | A | 3/1999 | Hayday et al. | |
| 5,925,469 | A * | 7/1999 | Gee | 428/447 |
| 5,942,007 | A | 8/1999 | Berndt et al. | |
| 5,977,040 | A | 11/1999 | Inada et al. | |
| 5,985,177 | A * | 11/1999 | Yoshida et al. | 424/401 |
| 5,985,810 | A | 11/1999 | Inada et al. | |
| 6,013,682 | A | 1/2000 | Dalle et al. | |
| 6,013,683 | A | 1/2000 | Hill et al. | |
| 6,042,617 | A | 3/2000 | Berndt et al. | |
| 6,042,618 | A | 3/2000 | Berndt et al. | |
| 6,056,789 | A | 5/2000 | Berndt et al. | |
| 6,059,845 | A | 5/2000 | Berndt et al. | |
| 6,060,546 | A | 5/2000 | Powell et al. | |
| 6,063,135 | A | 5/2000 | Berndt et al. | |
| 6,083,901 | A | 7/2000 | Perry et al. | |
| 6,086,903 | A * | 7/2000 | Trinh et al. | 424/401 |
| 6,114,298 | A | 9/2000 | Petri et al. | |
| 6,136,766 | A | 10/2000 | Inada et al. | |
| 6,136,778 | A | 10/2000 | Kamiya | |
| 6,156,074 | A | 12/2000 | Hayday et al. | |
| 6,162,423 | A * | 12/2000 | Sebag et al. | 424/70.12 |
| 6,177,399 | B1 | 1/2001 | Mei et al. | |
| 6,200,943 | B1 | 3/2001 | Romack et al. | |
| 6,258,130 | B1 | 7/2001 | Murphy et al. | |
| 6,273,919 | B1 | 8/2001 | Hayday et al. | |
| 6,283,336 | B1 * | 9/2001 | Dwyer et al. | 222/190 |
| 6,309,425 | B1 | 10/2001 | Murphy et al. | |
| 6,310,029 | B1 | 10/2001 | Kilgour et al. | |
| 6,312,476 | B1 | 11/2001 | Perry et al. | |

(Continued)

FOREIGN PATENT DOCUMENTS

| | | |
|---|---|---|
| DE | 1 496 248 | 2/1970 |
| DE | 26 28 480 A1 | 1/1978 |
| DE | 2644073 A1 | 4/1978 |
| DE | 37 39 711 A1 | 6/1989 |
| DE | 199 08 170 A1 | 10/1999 |
| EP | 0 182 583 | 5/1986 |
| EP | 0 246007 | 11/1987 |
| EP | 0 375 028 | 12/1989 |
| EP | 0 398 177 | 11/1990 |
| EP | 1 041 189 A1 | 10/2000 |

(Continued)

*Primary Examiner*—Charles Boyer
(74) *Attorney, Agent, or Firm*—S. W. Miller; K. W. Zerby

(57) ABSTRACT

The present invention relates to a surfactant system and a consumable detergent composition comprising the same.

3 Claims, No Drawings

U.S. PATENT DOCUMENTS

| | | | | |
|---|---|---|---|---|
| 6,313,079 | B1 | 11/2001 | Murphy | |
| 6,368,359 | B1 | 4/2002 | Perry et al. | |
| 6,482,400 | B1 * | 11/2002 | Collin | 424/70.6 |
| 6,521,580 | B2 | 2/2003 | Perry et al. | |
| 6,548,465 | B2 | 4/2003 | Perry et al. | |
| 6,610,108 | B2 | 8/2003 | Perry et al. | |
| 6,670,317 | B2 * | 12/2003 | Severns et al. | 510/285 |
| 6,673,764 | B2 * | 1/2004 | Severns et al. | 510/419 |
| 6,691,536 | B2 * | 2/2004 | Severns et al. | 68/12.27 |
| 6,706,076 | B2 | 3/2004 | Deak et al. | |
| 6,706,677 | B2 * | 3/2004 | Burns et al. | 510/286 |
| 6,734,153 | B2 * | 5/2004 | Scheper | 510/285 |
| 6,828,295 | B2 * | 12/2004 | Deak et al. | 510/466 |
| 6,894,014 | B2 * | 5/2005 | Deak et al. | 510/285 |
| 6,929,939 | B2 * | 8/2005 | Estell et al. | 435/220 |
| 6,972,279 | B2 * | 12/2005 | Deak et al. | 510/466 |
| 2002/0004953 | A1 | 1/2002 | Perry et al. | |
| 2002/0007519 | A1 | 1/2002 | Noyes et al. | |
| 2002/0133885 | A1 | 9/2002 | Noyes et al. | |
| 2003/0060396 | A1 | 3/2003 | Deak et al. | |
| 2003/0074742 | A1 | 4/2003 | Perry et al. | |
| 2003/0081793 | A1 | 5/2003 | Deak et al. | |
| 2003/0119711 | A1 | 6/2003 | Scheper et al. | |
| 2004/0033924 | A1 * | 2/2004 | Murphy et al. | 510/421 |
| 2004/0142838 | A1 | 7/2004 | Azuma et al. | |
| 2004/0266643 | A1 | 12/2004 | Gardner et al. | |
| 2005/0000027 | A1 | 1/2005 | Baker et al. | |
| 2005/0000028 | A1 | 1/2005 | Baker et al. | |
| 2005/0000030 | A1 | 1/2005 | Dupont et al. | |
| 2005/0003981 | A1 | 1/2005 | Sivik et al. | |
| 2005/0009723 | A1 | 1/2005 | Haeggberg et al. | |

FOREIGN PATENT DOCUMENTS

| | | | |
|---|---|---|---|
| EP | 1 092 803 | A1 | 4/2001 |
| EP | 1 304 158 | A1 | 4/2003 |
| GB | 1 252 744 | | 11/1971 |
| JP | 53018646 | A | 2/1978 |
| JP | 0 4245970 | | 9/1991 |
| JP | 5171566 | | 7/1993 |
| JP | 11323381 | | 11/1999 |
| JP | 2000-290689 | | 10/2000 |
| JP | 2003041290 | | 2/2003 |
| WO | WO 94/23012 | | 10/1997 |
| WO | WO 99/16955 | | 4/1999 |
| WO | WO 00/04221 | | 1/2000 |
| WO | WO 00/04222 | | 1/2000 |
| WO | WO 00/63340 | | 10/2000 |
| WO | WO 01/04254 | A1 | 1/2001 |
| WO | WO 01/40567 | A1 | 6/2001 |

* cited by examiner

CONSUMABLE DETERGENT COMPOSITION FOR USE IN A LIPOPHILIC FLUID

CROSS REFERENCE TO RELATED APPLICATION

The present application claims priority under 35 U.S.C. §119(e) to U.S. provisional application No. 60/483,345, filed Jun. 27, 2003.

FIELD OF THE INVENTION

The present invention relates to a surfactant system and a consumable detergent composition comprising the same.

BACKGROUND OF THE INVENTION

A non-aqueous solvent based washing system utilizing lipophilic fluid, such as cyclic siloxanes (especially cyclopentasiloxanes, sometimes termed "D5"), particularly for use with washing machines for in-home use, has recently been developed. Such a system is particularly desired for cleaning textile articles without causing damage associated with wet-washing, like shrinkage and dye transfer. To maximize fabric cleaning in such a system it is necessary to use additives for cleaning, softening, finishing, and other similar benefits. Traditional water soluble surfactants, such as anionic surfactants, do not function in the same manner in a non-aqueous solvent based washing system utilizing lipophilic fluid compared to a water-based washing system. The surfactant system in a non-aqueous solvent based washing system may be altered dependent upon what type of soil is targeted. Greasy soils, traditionally posing problems in water-based systems, are not as challenging in lipophilic fluid based systems, such as the present invention. However, hydrophilic soils, traditionally posing no problems in water-based systems, raise challenges in lipophilic fluid based systems. Optimization of a surfactant system in a non-aqueous solvent based washing system utilizing lipophilic fluid is an unmet need. Therefore, an unmet need exists for an optimized surfactant system for use in a non-aqueous solvent based washing system utilizing lipophilic fluid and a detergent composition for use in the same.

SUMMARY OF THE INVENTION

The present invention relates to a surfactant system for use in a lipophilic liquid comprising at least two surfactants selected from the group comprising of from about 0.1 wt % to about 30 wt % of a silicone surfactant; from about 0.1 wt % to about 99 wt % of a nonionic surfactant; from about 0 wt % to about 50 wt % of a gemini surfactant; and from about 0 wt % to about 50 wt % of a anionic surfactant.

The present invention also relates to a consumable detergent composition for use in a lipophilic fluid comprising: a) from about 1 wt % to about 100 wt % of a surfactant system comprising at least two surfactants consisting of from about 0.1 wt % to about 75 wt % of a silicone surfactant; from about 0.1 wt % to about 99 wt % of a nonionic surfactant; from about 0 wt % to about 40 wt % of a gemini surfactant; from about 0 wt % to about 75 wt % of a anionic surfactant; and b) from about 0 wt % to about 75 wt % of a fatty acid, fatty acid salt and mixtures thereof; c) from about 0 wt % to about 75 wt % of a fatty quat comprising a nitrogen substituted by at least one hydrophobic tail comprising from 2 to 20 carbon atoms; and d) from about 0 wt % to about 75 wt % of the consumable detergent composition of a polar solvent, a mixture of polar solvents and adjuncts.

DETAILED DESCRIPTION OF THE INVENTION

The term "fabric article" used herein is intended to mean any article that is customarily cleaned in a conventional laundry process or in a dry cleaning process. As such, the term encompasses articles of clothing, linen, drapery, and clothing accessories. The term also encompasses other items made in whole or in part of fabric, such as tote bags, furniture covers, tarpaulins and the like.

The term "lipophilic fluid" used herein is intended to mean any nonaqueous fluid capable of removing sebum, as described in more detail herein below.

The term "soil" means any undesirable substance on a fabric article that is desired to be removed. By the terms "water-based" or "hydrophilic" soils, it is meant that the soil comprised water at the time it first came in contact with the fabric article, that the soil has high water solubility or affinity, or the soil retains a significant portion of water on the fabric article. Examples of water-based soils include, but are not limited to beverages, many food soils, water soluble dyes, bodily fluids such as sweat, urine or blood, outdoor soils such as grass stains and mud.

The term "consumable detergent composition" means any composition, that when combined with a lipophilic fluid, result in a cleaning solution useful according to the present invention that comes into direct contact with fabric articles to be cleaned. It should be understood that the term encompasses uses other than cleaning, such as conditioning and sizing.

The term "processing aid" refers to any material that renders the consumable detergent composition more suitable for formulation, stability, and/or dilution with a lipophilic fluid to form a consumable detergent composition useful for the present invention.

The term "mixing" as used herein means combining two or more materials (i.e., fluids, more specifically a lipophilic fluid and a consumable detergent composition) in such a way that a homogeneous mixture is formed, homogeneous is intended to include emulsions. Suitable mixing processes are known in the art. Nonlimiting examples of suitable mixing processes include vortex mixing processes and static mixing processes.

"Down the drain", as used herein, means both the conventional in-home disposal of materials into the municipal water waste removal systems such as by sewer systems or via site specific systems such as septic systems, as well as for commercial applications the removal to on-site water treatment systems or some other centralized containment means for collecting contaminated water from the facility.

Incorporated and included herein, as if expressly written herein, are all ranges of numbers when written in a "from X to Y" or "from about X to about Y" format. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

Surfactant System

The surfactant system of the present invention can be a mixture of surfactants that are capable of suspending water in a lipophilic fluid and/or enhancing soil removal benefits of a lipophilic fluid. The surfactants may be soluble in the lipophilic fluid.

The surfactant system of the present invention comprises at least one silicone surfactant and at least one nonionic surfactant, and preferably comprises more than one surfactant selected from the group consisting of silicone surfactants, nonionic surfactants, gemini surfactants, anionic surfactants and mixtures thereof. Another embodiment of the present invention comprises a surfactant system comprising at least one silicone surfactant, at least one nonionic surfactant and and preferably comprises more than one surfactant selected from the group consisting of silicone surfactants, nonionic surfactants, gemini surfactants, anionic surfactants, and further comprising a fatty acid, a fatty acid salt, and mixtures thereof, and mixtures thereof. A mixture of surfactants may be selected from the same class (e.g., two or more nonionic surfactants) or may be selected from two or more classes of surfactants (e.g., one anionic, one nonionic, and one silicone surfactant).

Silicone Surfactants

The surfactant systems of the present invention comprise at least one silicone surfactant. Additionally, the silicone surfactant should provide improved cleaning benefits compared to the lipophilic fluid utilized in the non-aqueous based washing system. One class of silicone surfactants can include siloxane-based surfactants (siloxane-based materials). The siloxane-based surfactants typically have a weight average molecular weight from 500 to 20,000 daltons. Such materials, derived from poly(dimethylsiloxane), are well known in the art. In the present invention, not all such siloxane-based surfactants are suitable, because they do not provide improved cleaning of soils compared to the level of cleaning provided by the lipophilic fluid itself.

Suitable siloxane-based surfactants comprise a polyether siloxane having the formula (I):

$$M_aD_bD'_cD''_dM'_{2-a} \quad (I)$$

wherein a of formula (I) is 0–2; b of formula (I) is 0–1000; c of formula (I) is 0–50; d of formula (I) is 0–50, provided that a+c+d of formula (I) is at least 1;

M of formula (I) is $R^1_{3-e}X_eSiO_{1/2}$ wherein $R^1$ of formula (I) is independently H, or a monovalent hydrocarbon group, X of formula (I) is hydroxyl group, and e of formula (I) is 0 or 1;

M' of formula (I) is selected from $C_{1-4}$ alkyl, $C_{1-4}$ hydroalkyl, $R^2_3SiO_{1/2}$ or mixtures thereof, wherein $R^2$ of formula (I) is independently H, a monovalent hydrocarbon group, or $(CH_2)_f(C_6Q_4)_gO—(C_2H_4O)_h—(C_3H_6O)_i(C_kH_{2k})_j—R^3$ (formula (II)), provided that at least one $R^2$ of formula (I) is $(CH_2)_f(C_6Q_4)_gO—(C_2H_4O)_h—(C_3H_6O)_i(C_kH_{2k})_j—R^3$, wherein $R^3$ of formula (II) is independently H, a monovalent hydrocarbon group or an alkoxy group, f of formula (II) is 1–10, g of formula (II) is 0 or 1, h of formula (II) is 1–50, i of formula (II) is 0–50, j of formula (II) is 0–50, k of formula (II) is 4–8; $C_6Q_4$ of formula (II) is unsubstituted or substituted with Q of formula (II) is independently H, $C_{1-10}$ alkyl, $C_{1-10}$ alkenyl, and mixtures thereof.

D of formula (I) is $R^4_2SiO_{2/2}$ wherein $R^4$ of formula (I) is independently H or a monovalent hydrocarbon group;

D' of formula (I) is $R^5_2SiO_{2/2}$ wherein $R^5$ of formula (I) is independently $R^2$ of formula (I) provided that at least one $R^5$ of formula (I) is $(CH_2)_f(C_6Q_4)_gO—(C_2H_4O)_h—(C_3H_6O)_i(C_kH_{2k})_j—R^3$ (formula (III)), wherein $R^3$ of formula (III) is independently H, a monovalent hydrocarbon group or an alkoxy group, f of formula (III) is 1–10, g of formula (III) is 0 or 1, h of formula (III) is 1–50, i of formula (III) is 0–50, j of formula (III) is 0–50, k of formula (III) is 4–8; $C_6Q_4$ (III) is unsubstituted or substituted with Q of formula (III) is independently H, $C_{1-10}$ alkyl, $C_{1-10}$ alkenyl, and mixtures thereof.

D" of formula (I) is $R^6_2SiO_{2/2}$ wherein $R^6$ of formula (I) is independently H, a monovalent hydrocarbon group or $(CH_2)_t(C_6Q_4)_m(A)_n-[(L)_o-(A')_p-]_q-(L')_rZ(G)_s$ (formula (IV)) wherein 1 of formula (IV) is 1–10; m of formula (IV) is 0 or 1; n of formula (IV) is 0–5; o of formula (IV) is 0–3; p of formula (IV) is 0 or 1; q of formula (IV) is 0–10; r of formula (IV) is 0–3; s of formula (IV) is 0–3; $C_6Q_4$ of formula (IV) is unsubstituted or substituted with Q of formula (IV) is independently H, $C_{1-10}$ alkyl, $C_{1-10}$ alkenyl, and mixtures thereof; A and A' of formula (IV) are each independently a linking moiety representing an ester, a keto, an ether, a thio, an amido, an amino, a $C_{1-4}$ fluoroalkyl, a $C_{1-4}$ fluoroalkenyl, a branched or straight chained polyalkylene oxide, a phosphate, a sulfonyl, a sulfate, an ammonium, and mixtures thereof; L and L' of formula (IV) are each independently a $C_{1-30}$ straight chained or branched alkyl or alkenyl or an aryl which is unsubstituted or substituted; Z of formula (IV) is a hydrogen, carboxylic acid, a hydroxy, a phosphate, a phosphate ester, a sulfonyl, a sulfonate, a sulfate, a branched or straight-chained polyalkylene oxide, a nitryl, a glyceryl, an aryl unsubstituted or substituted with a $C_{1-30}$ alkyl or alkenyl, a carbohydrate unsubstituted or substituted with a $C_{1-10}$ alkyl or alkenyl or an ammonium; G of formula (IV) is an anion or cation such as $H^+$, $Na^+$, $Li^+$, $K^+$, $NH_4^+$, $Ca^{+2}$, $Mg^{+2}$, $Cl^-$, $Br^-$, $I^-$, mesylate or tosylate.

Examples of the types of siloxane-based surfactants described herein above may be found in EP-1,043,443A1, EP-1,041,189 and WO-01/34,706 (all to GE Silicones) and U.S. Pat. No. 5,676,705, U.S. Pat. No. 5,683,977, U.S. Pat. No. 5,683,473, and EP-1,092,803A1 (all assigned to Lever Brothers).

Nonlimiting commercially available examples of suitable siloxane-based surfactants are TSF 4446 (ex. General Electric Silicones), XS69-B5476 (ex. General Electric Silicones); Jenamine HSX (ex. DelCon) and Y12147 (ex. OSi Specialties).

Nonionic Surfactants

The surfactant systems of the present invention comprise at least one nonionic surfactant. Non-limiting examples of nonionic surfactants include the nonionic surfactants below wherein the indicated carbon ranges are that of the hydrophobic portion (tail) of the surfactant.

a) $C_6$–$C_{12}$ alkyl phenol alkoxylates wherein the alkoxylate units are a mixture of ethyleneoxy and propyleneoxy units;
b) $C_{12}$–$C_{18}$ alcohol and $C_6$–$C_{12}$ alkyl phenol condensates with ethylene oxide/propylene oxide block polymers such as PLURONIC® from BASF;
c) $C_{14}$–$C_{22}$ mid-chain branched alcohols, BA, as discussed in U.S. Pat. No. 6,150,322;
d) $C_{14}$–$C_{22}$ mid-chain branched alkyl alkoxylates, $BAE_x$, wherein x 1–30, as discussed in U.S. Pat. No. 6,153,577, U.S. Pat. No. 6,020,303 and U.S. Pat. No. 6,093,856;
e) Alkylpolysaccharides as discussed in U.S. Pat. No. 4,565,647 by Llenado, issued Jan. 26, 1986; specifically alkylpolyglycosides as discussed in U.S. Pat. No. 4,483,780 and U.S. Pat. No. 4,483,779;
f) Polyhydroxy fatty acid amides as discussed in U.S. Pat. No. 5,332,528, WO 92/06162, WO 93/19146, WO 93/19038, and WO 94/09099;

g) ether capped poly(oxyalkylated) alcohol surfactants as discussed in U.S. Pat. No. 6,482,994 and WO 01/42408;

h) Polyethylene oxide condensates of nonyl phenol and myristyl alcohol, such as in U.S. Pat. 4,685,930;

i) fatty alcohol ethoxylates, nonlimiting examples of ethoxylated materials, such as ethoxylated surfactants include compounds having the general formula (V):

$$R^8\text{-}Z\text{-}(CH_2CH_2O)_sB \quad (V)$$

wherein $R^8$ of formula (V) is an alkyl group or an alkyl aryl group, selected from the group consisting of primary, secondary and branched chain alkyl hydrocarbyl groups, primary, secondary and branched chain alkenyl hydrocarbyl groups, and/or primary, secondary and branched chain alkyl- and alkenyl-substituted phenolic hydrocarbyl groups having a hydrophobic portion (tail) from about 6 to about 20 carbon atoms, preferably from about 8 to about 18, more preferably from about 10 to about 15 carbon atoms; s of formula (V) is an integer from about 1 to about 45, preferably from about 1 to about 20, more preferably from about 1 to about 15; B of formula (V) is a hydrogen, a carboxylate group, or a sulfate group; and linking group Z of formula (V) is —O—, —C(O)O—, —C(O)N(R)—, —CN(O)R— and mixtures thereof, in which R of formula (V), when present, is $R^8$ of formula (V) or hydrogen. Nonlimiting examples of preferred ethoxylated surfactant are straight-chain, primary alcohol ethoxylates, with $R^8$ of formula (V) being $C_8$–$C_{18}$ alkyl and/or alkenyl group, more preferably $C_{10}$–$C_{14}$, and s of formula (V) being from about 2 to about 8, preferably from about 2 to about 6; straight-chain, secondary alcohol ethoxylates, with $R^8$ of formula (V) being $C_8$–$C_{18}$ alkyl and/or alkenyl, e.g., 3-hexadecyl, 2-octadecyl, 4-eicosanyl, and 5-eicosanyl, and s being from about 2 to about 10. A preferred ethoxylated material is shown by formula (VI):

(VI)

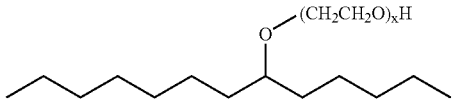

wherein x of formula (VI) is from about 0 to about 10, preferably from about 0 to about 7, most preferably from about 0 to about 6. Another preferred ethoxylated material has 15 carbons similar to the formula (VI), wherein ethoxylation is from about 0 to about 10, preferably from about 0 to about 7, most preferably from about 0 to about 6. Also preferred ethoxlated materials comprise blends of carbon chainlengths from 10 to 16, wherein ethoxylation is from about 0 to about 10, preferably from about 0 to about 7, and most preferably from about 0 to about 6.

Gemini Surfactants

The surfactant systems of the present invention may optionally comprise a gemini surfactant. Gemini surfactants are compounds having at least two hydrophobic groups and at least one or optionally two hydrophilic groups per molecule have been introduced. These have become known as "gemini surfactants" in the literature, e.g., Chemtech, March 1993, pp 30–33, and J. American Chemical Soc., 115, 10083–10090 (1993) and the references cited therein.

A number of the gemini surfactants are reported in the literature, see for example, Okahara et al., J. Japan Oil Chem. Soc. 746 (Yukagaku) (1989); Zhu et al., 67 JAOCS 7,459 (July 1990); Zhu et al., 68 JAOCS 7,539 (1991); Menger et al., J. Am. Chemical Soc. 113, 1451 (1991); Masuyama et al., 41 J. Japan Chem. Soc. 4,301 (1992); Zhu et al., 69 JAOCS 1,30 (January 1992); Zhu et al., 69 JAOCS 7,626 July 1992); Menger et al., 115 J. Am. Chem. Soc. 2, 10083 (1993); Rosen, Chemtech 30 (March 1993); and Gao et al., 71 JAOCS 7,771 (July 1994).

A number of gemini surfactants have also been disclosed in the patent literature including U.S. Pat. No. 5,160,450, U.S. Pat. No. 3,244,724, U.S. Pat. Nos. 2,524,218, 2,530,147, 2,374,354, and U.S. Pat. No. 6,358,914.

The following are nonlimiting examples of Gemini surfactants suitable for use in the present invention:

(VII)

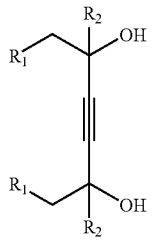

(VIII)

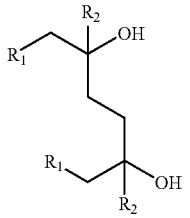

(IX)

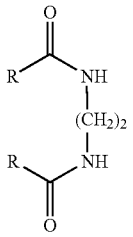

(X)

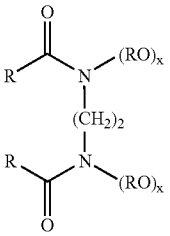

(XI)

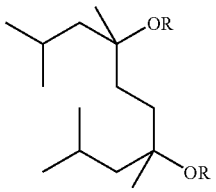

wherein $R_1$, and $R_2$ of formulas (VII)–(VIII) and R of formulas (IX), (X) and (XI), are same or different and are independently selected from H, $C_{1-30}$ alkyl, $C_{2-20}$ alkenyl; and x of formula (X) is from 0.1 to 60.

Anionic Surfactants

The surfactant systems of the present invention may optionally comprise an anionic surfactant. Nonlimiting examples of anionic surfactants useful herein are listed below wherein the indicated carbon ranges are that of the hydrophobic portion (tail) of the surfactant.

a) $C_{11}$–$C_{18}$ alkyl benzene sulfonates (LAS);

b) $C_{10}$–$C_{20}$ primary, branched-chain and random alkyl sulfates (AS);

c) $C_{10}$–$C_{18}$ secondary (2,3) alkyl sulfates having formulas (XII) and (XIII):

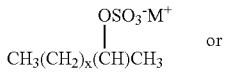

(XII)

or

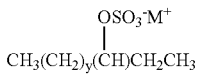

(XIII)

M in formulas (XII) and (XIII) is hydrogen or a cation which provides charge neutrality. Non-limiting examples of preferred cations include sodium, potassium, ammonium, and mixtures thereof. Wherein x in formula (XII) is an integer of at least about 7, preferably at least about 9; y in formula (XIII) is an integer of at least 8, preferably at least about 9;

d) $C_{10}$–$C_{18}$ alkyl alkoxy sulfates ($AE_xS$) wherein preferably x is from 1–30;

e) $C_{10}$–$C_{18}$ alkyl alkoxy carboxylates preferably comprising 1–5 ethoxy units;

f) mid-chain branched alkyl sulfates as discussed in U.S. Pat. No. 6,020,303 and U.S. Pat. No. 6,060,443;

g) mid-chain branched alkyl alkoxy sulfates as discussed in U.S. Pat. No. 6,008,181 and U.S. Pat. No. 6,020,303;

h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548;

i) $C_{12}$–$C_{20}$ methyl ester sulfonate (MES);

j) $C_{10}$–$C_{18}$ alpha-olefin sulfonate (AOS); and k) $C_6$–$C_{20}$ Sulfosuccinates available under the trade names of AEROSOL OT® and AEROSOL TR-70® (ex. Cytec).

In one embodiment, the surfactant system of the present invention comprises from about 0.1 wt % to about to about 50 wt %, preferably from about 0.1 wt % to about 25 wt %, preferably from about 1 wt % to about 15 wt %, preferably from about 5 wt % to about 15 wt % by weight of the surfactant system of at least one silicone surfactant and from about 0.1 wt % to about 99 wt %, preferably from about 0.1 wt % to about 85 wt %, preferably from about 10 wt % to about 60 wt %, and preferably from about 35 wt % to about 85 wt % by weight of the surfactant system of at least one nonionic surfactant; from about 0 wt % to about 50 wt %, preferably from about 0 wt % to about 45 wt %, preferably from about 0 wt % to about 10 wt % by weight of the surfactant system of at least one gemini surfactant; from about 0 wt % to about 50 wt %, from about 0 wt % to about 45 wt %, preferably from about 10 wt % to about 50 wt %, preferably from about 15 wt % to about 45 wt % by weight of the surfactant system of at least one anionic surfactant.

Another embodiment of the surfactant system of the present invention comprises from about 0.1 wt % to about to about 50 wt %, preferably from about 0.1 wt % to about 25 wt %, preferably from about 1 wt % to about 15 wt %, preferably from about 5 wt % to about 15 wt % by weight of the surfactant system of at least one silicone surfactant; from about 0.1 wt % to about 99 wt %, preferably from about 0.1 wt % to about 85 wt %, preferably from about 0.1 wt % to about 75 wt %, preferably from about 10 wt % to about 60 wt %, preferably from about 25 wt % to about 85 wt %, and preferably from about 35 wt % to about 99 wt % by weight of the surfactant system of at least one nonionic surfactant; from about 0 wt % to about 50 wt %, preferably from about 0 wt % to about 45 wt %, preferably from about 0 wt % to about 10 wt % by weight of the surfactant system of at least one gemini surfactant; from about 0 wt % to about 50 wt %, from about 0 wt % to about 45 wt %, preferably from about 10 wt % to about 50 wt %, preferably from about 15 wt % to about 45 wt % by weight of the surfactant system of at least one anionic surfactant; and the surfactant system further comprising from about 0 wt % to about 75 wt % by weight of the surfactant system of at least one fatty acid, fatty acid salt, and mixtures thereof. Optionally if a fatty acid, fatty acid salt, and mixtures thereof that is not present then an anionic surfactant must be present.

In another embodiment, the consumable detergent composition comprises a surfactant system comprises from about 0.1 wt % to about 30 wt %, preferably from about 0.1 wt % to about 20 wt %, preferably from about 0.1 wt % to about 15 wt %, preferably from about 1 wt % to about 15 wt %, preferably from about 5 wt % to about 15 wt %, by weight of the consumable detergent composition of at least one silicone surfactant; from about 0.1 wt % to about 99 wt %, preferably from about 10 wt % to about 99 wt %; preferably from about 10 wt % to about 60 wt %, preferably from about 35 wt % to about 75 wt %, preferably from about 40 wt % to about 70 wt % by weight of the consumable detergent composition of at least one nonionic surfactant; from about 0 wt % to about 50 wt %, from about 0 wt % to about 30 wt %, preferably from about 0 wt % to about 20 wt %, preferably from about 0 wt % to about 10 wt %, by weight of the consumable detergent composition of at least one gemini surfactant; from about 0 wt % to about 75 wt %, preferably from about 0 wt % to about 50 wt %, preferably from about 0 wt % to about 25 wt %, preferably from about 10 wt % to about 75 wt %, by weight of the consumable detergent composition of at least one anionic surfactant.

In another embodiment, the consumable detergent composition comprises a surfactant system comprises from about 0.1 wt % to about 30 wt %, preferably from about 0.1 wt % to about 20 wt %, preferably from about 0.1 wt % to about 15 wt %, preferably from about 1 wt % to about 15 wt %, preferably from about 5 wt % to about 15 wt %, by weight of the consumable detergent composition of at least one silicone surfactant; from about 0.1 wt % to about 99 wt %, preferably from about 0.1% to about 75 wt %, preferably from about 10 wt % to about 99 wt %; preferably from 10 wt % to about 75 wt %, preferably from about 10 wt % to about 60 wt %, preferably from about 35 wt % to about 75 wt %, preferably from about 40 wt % to about 70 wt % by weight of the consumable detergent composition of at least one nonionic surfactant; from about 0 wt % to about 50 wt %, from about 0 wt % to about 30 wt %, preferably from about 0 wt % to about 20 wt %, preferably from about 0 wt % to about 10 wt %, preferably from about 15 wt % to about 30 wt %, by weight of the consumable detergent composition of at least one gemini surfactant; from about 0 wt % to about 75 wt %, preferably from about 0 wt % to about 50 wt %, preferably from about 0 wt % to about 25 wt %, preferably from about 10 wt % to about 75 wt %, by weight of the consumable detergent composition of at least one anionic surfactant. Optionally, if the anionic surfactant is not present a fatty acid, fatty acid salt, and mixtures thereof is present. The consumable detergent composition of the present invention may further comprises from about 0 wt % to about 75 wt % by weight of the consumable detergent composition of at least one fatty acid, fatty acid salt, and mixtures thereof. Optionally, if a fatty acid, fatty acid salt, and mixtures thereof that is not present then an anionic surfactant is present.

Consumable Detergent Composition

The consumable detergent composition of the present invention comprises a surfactant system, optionally a fatty acid, fatty acid salt, and mixtures thereof, optionally a fatty quat, and optionally at least one cleaning adjunct. The surfactant system may be altered dependent upon what type of soil is targeted. Greasy soils, traditionally posing problems in water-based systems, are not as challenging in lipophilic fluid based systems, such as the present invention. However, hydrophilic soils, traditionally posing no problems in water-based systems, now raises challenges in lipophilic fluid based systems. Specifically, hydrophilic soils on cotton fabric articles are especially difficult to address in a non-aqueous solvent based washing system utilizing lipophilic fluid.

Lipophilic Fluid

"Lipophilic fluid" as used herein means any liquid or mixture of liquids that are immiscible with water at up to 20% by weight of water. In general, a suitable lipophilic fluid can be fully liquid at ambient temperature and pressure, can be an easily melted solid, e.g., one that becomes liquid at temperatures in the range from about 0° C. to about 60° C., or can comprise a mixture of liquid and vapor phases at ambient temperatures and pressures, e.g., at 25° C. and 101.3 kPa (1 atm) pressure.

It is preferred that the lipophilic fluid herein be nonflammable or, have relatively high flash points and/or low VOC characteristics, these terms having conventional meanings as used in the dry cleaning industry, to equal or, preferably, exceed the characteristics of known conventional dry cleaning fluids.

Non-limiting examples of suitable lipophilic fluid materials include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof.

"Siloxane" as used herein means silicone fluids that are non-polar and insoluble in water or lower alcohols. Linear siloxanes (see for example U.S. Pat. Nos. 5,443,747, and 5,977,040) and cyclic siloxanes are useful herein, including the cyclic siloxanes selected from the group consisting of octamethyl-cyclotetrasiloxane (tetramer), dodecamethyl-cyclohexasiloxane (hexamer), and preferably decamethyl-cyclopentasiloxane (pentamer, commonly referred to as "D5"). A preferred siloxane comprises more than about 50% cyclic siloxane pentamer, more preferably more than about 75% cyclic siloxane pentamer, most preferably at least about 90% of the cyclic siloxane pentamer. Also preferred for use herein are siloxanes that are a mixture of cyclic siloxanes having at least about 90% (preferably at least about 95%) pentamer and less than about 10% (preferably less than about 5%) tetramer and/or hexamer.

The lipophilic fluid can include any fraction of dry-cleaning solvents, especially newer types including fluorinated solvents, or perfluorinated amines. Some perfluorinated amines such as perfluorotributylamines, while unsuitable for use as lipophilic fluid, may be present as one of many possible adjuncts present in the lipophilic fluid-containing composition.

Other suitable lipophilic fluids include, but are not limited to, diol solvent systems e.g., higher diols such as $C_6$ or $C_8$ or higher diols, organosilicone solvents including both cyclic and acyclic types, and the like, and mixtures thereof.

Non-limiting examples of low volatility non-fluorinated organic solvents include for example OLEAN® and other polyol esters, or certain relatively nonvolatile biodegradable mid-chain branched petroleum fractions.

Non-limiting examples of glycol ethers include propylene glycol methyl ether, propylene glycol n-propyl ether, propylene glycol t-butyl ether, propylene glycol n-butyl ether, dipropylene glycol methyl ether, dipropylene glycol n-propyl ether, dipropylene glycol t-butyl ether, dipropylene glycol n-butyl ether, tripropylene glycol methyl ether, tripropylene glycol n-propyl ether, tripropylene glycol t-butyl ether, tripropylene glycol n-butyl ether.

Non-limiting examples of other silicone solvents, in addition to the siloxanes, are well known in the literature, see, for example, Kirk Othmer's Encyclopedia of Chemical Technology, and are available from a number of commercial sources, including GE Silicones, Toshiba Silicone, Bayer, and Dow Corning. For example, one suitable silicone solvent is SF-1528 available from GE Silicones.

Non-limiting examples of suitable glycerine derivative solvents for use in the methods and/or apparatuses of the present invention include glyercine derivatives having the formula (XIV):

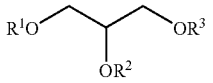

(XIV)

wherein $R^1$, $R^2$ and $R^3$ of formula (XIV) are each independently selected from: H; branched or linear, substituted or unsubstituted $C_1$–$C_{30}$ alkyl, $C_2$–$C_{30}$ alkenyl, $C_1$–$C_{30}$ alkoxycarbonyl, $C_3$–$C_{30}$ alkyleneoxyalkyl, $C_1$–$C_{30}$ acyloxy, $C_7$–$C_{30}$ alkylenearyl; $C_4$–$C_{30}$ cycloalkyl; $C_6$–$C_{30}$ aryl; and mixtures thereof. Two or more of $R^1$, $R^2$ and $R^3$ of formula (XIV) together can form a $C_3$–$C_8$ aromatic or non-aromatic, heterocyclic or non-heterocyclic ring.

Non-limiting examples of suitable glycerine derivative solvents include 2,3-bis(1,1-dimethylethoxy)-1-propanol; 2,3-dimethoxy-1-propanol; 3-methoxy-2-cyclopentoxy-1-propanol; 3-methoxy-1-cyclopentoxy-2-propanol; carbonic acid (2-hydroxy-1-methoxymethyl)ethyl ester methyl ester; glycerol carbonate and mixtures thereof.

Non-limiting examples of other environmentally-friendly solvents include lipophilic fluids that have an ozone formation potential of from 0 to about 0.31, lipophilic fluids that have a vapor pressure of from 0 to about 13.3 Pa (0 to about 0.1 mm Hg), and/or lipophilic fluids that have a vapor pressure of greater than 13.3 Pa (0.1 mm Hg), but have an ozone formation potential of from 0 to about 0.31. Non-limiting examples of such lipophilic fluids that have not previously been described above include carbonate solvents (i.e., methyl carbonates, ethyl carbonates, ethylene carbonates, propylene carbonates, glycerine carbonates) and/or succinate solvents (i.e., dimethyl succinates).

"Ozone Reactivity" as used herein is a measure of a VOC's ability to form ozone in the atmosphere. It is measured as grams of ozone formed per gram of volatile organics. A methodology to determine ozone reactivity is discussed further in W. P. L. Carter, "Development of Ozone Reactivity Scales of Volatile Organic Compounds", Journal of the Air & Waste Management Association, Vol. 44, Pages 881–899, 1994. "Vapor Pressure" as used can be measured by techniques defined in Method 310 of the California Air Resources Board.

Preferably, the lipophilic fluid comprises more than 50% by weight of the lipophilic fluid of cyclopentasiloxanes, ("D5") and/or linear analogs having approximately similar volatility, and optionally complemented by other silicone solvents.

Fatty Acid, Fatty Acid Salt, and Mixtures Thereof

Consumable detergents composition according to the present invention may comprise a fatty acid, fatty acid salt, and mixtures thereof. Surfactant systems of the present invention may comprise a fatty acid, fatty acid salt, and mixtures thereof, optionally comprising a fatty acid, fatty acid salt, and mixtures thereof when no anionic surfactant is present. Suitable fatty acids and fatty acid salts are suitably selected from mono- and di-carboxylic acids comprising the following hydrophobes: saturated or unsaturated, linear or branched hydrocarbons having 6–30 carbons, preferred are branched and/or saturated mono- and di-carboxylic acids; ethoxylated alcohols, polyalkylene oxides (polypropyleneoxide, polybutyleneoxide, polyhexyleneoxide), including pure homopolymers or any copolymers and oligomers; linear or branched siloxanes, hydroxyl-functionalized silicones, alkoxylated silicones (e.g., ethoxylated/propylated silicones), alkylphosphonates, alkylphosphinates, phosphate monoesters of hydrophobic alcohols, phosphate diesters of hydrophobic alcohols; and mixtures thereof.

Suitable fatty acid salts have counterions selected from hydrogen, ammonium, $C_1$–$C_{20}$ alkylammonium, sodium, potassium, and the like.

Phosphate monoester and diesters of hydrophobic alcohols include $C_6$–$C_{20}$ linear or branched alkyl phosphate monoester or phosphate diesters. The acid form of the phosphate ester (i.e., protonated ester) and corresponding salts are intended to be included. Preferred phosphate monoesters and diesters include those represented by formula (XV):

(XV)

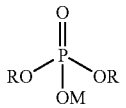

wherein R of formula (XV) is selected from a $C_{6-20}$ alkyl, silicone and mixtures thereof. M is a suitable counterion selected from hydrogen, sodium, ammonium, $C_1$–$C_{20}$ alkylammonium and mixtures thereof.

Preferred phosphate monoesters comprise formula (XVI) and phosphate diesters comprise formula (XVII). It would be apparent to one of skill in the art that the alkylphosponates may be selected from a fatty acid and fatty acid salt forms. Not to be limited to the shown formulas, the monester is exemplified in a fatty acid form (formula (XVI)) and the diester is exemplified in a suitable fatty acid salt form (formula (XVII)):

(XVI)

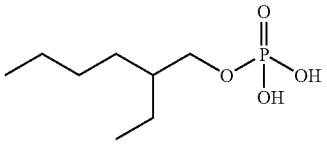

(XVII)

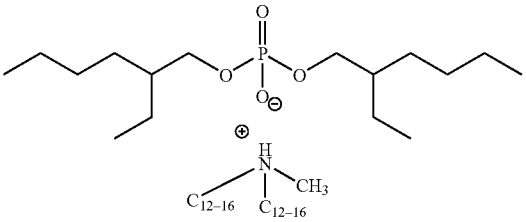

Alkylphosphonates may comprise formula (XVIII)

(XVIII)

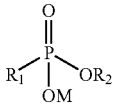

Wherein $R^1$ of formula (XVIII) is selected from a linear or branched $C_6$–$C_{20}$ alkyl, silicone, and mixtures thereof. $R_2$ of formula (XVIII) is selected from a linear or branched $C_6$–$C_{20}$ alkyl, silicone, and mixtures thereof. M of formula (XVIII) is a suitable counterion selected from hydrogen, sodium, ammonium, $C_1$–$C_{20}$ alkylammonium and mixtures thereof. It would be apparent to one of skill in the art that the alkylphosponates may be selected from a fatty acid and fatty acid salt forms. Not to be limited to the shown formulae, shown in formula (XIX) is an alkylphosphonates fatty acid while an alkylphosphonates fatty acid salt is shown in formula (XX).

(XIX)

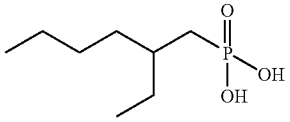

(XX)

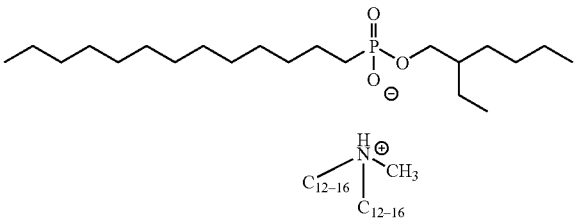

Alkylphosphinates may comprise formula (XXI):

(XXI)

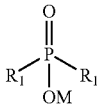

Wherein $R^1$ of formula (XXI) is selected from a linear or branched $C_6$–$C_{20}$ alkyl, silicone, and mixtures thereof. M of formula (XXI) is a suitable counterion selected from hydrogen, sodium, ammonium, $C_1$–$C_{20}$ alkylammonium and mixtures thereof. It would be apparent to one of skill in the art that the alkylphosphinates may be selected from a fatty acid and fatty acid salt forms. Not to be limited to the shown formulae, shown in formula (XXII) is a alkylphosphinate fatty acid (XXII)

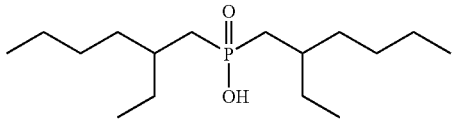

Fatty acid, fatty acid salt, and mixtures thereof may comprise from about 0 wt % to about 75 wt %, preferably from about 5 wt % to about 40 wt % by weight of the consumable detergent composition of a fatty acid, fatty acid salt, and mixtures thereof. The fatty acid, fatty acid salt, and mixtures thereof have from 2 to 20 carbon atoms, preferably from 10 to 18 carbon atoms. The fatty acid, fatty acid salt, and mixtures thereof may comprise from about 0 wt % to about 75 wt % by weight of the surfactant system, preferably from 0.1 wt % to about 75 wt % by weight of the surfactant system if no anionic surfactant is present.

Fatty Quat

The consumable detergent composition according to the present invention may comprise a fatty quat. Fatty quats may comprise from about 0 wt % to about 75 wt %, preferably from about 2 wt % to about 20 wt % by weight of the consumable detergent composition. The fatty quat comprises substituted nitrogen wherein the nitrogen is substituted with at least one moiety comprising from about 2 to about 20 carbon atoms, preferably from about 14 to about 20 carbon atoms.

Nonlimited examples of the fatty quat may include conventional fabric softening actives. Such fatty quats may include, but are not limited to dialkyldimethylammonium salts having the formula (XIV).

$$R'R''N^+(CH_3)_2X \quad \text{(XIV)}$$

wherein each R' and R" of formula (XIV) are independently selected from the group consisting of 12–30 carbon atoms or derived from tallow, coconut oil or soy, X of formula (XIV) is selected from anionic counter ions, including but not limited to $Cl^-$ or $Br^-$. Nonlimiting examples of the dialkyledimethylammonium salts include: didodecyldimethylammonium bromide (DDAB), dihexadecyldimethyl ammonium chloride, dihexadecyldimethyl ammonium bromide, dioctadecyidimethyl ammonium chloride, dieicosyldimethyl ammonium chloride, didocosyldimethyl ammonium chloride, dicoconutdimethyl ammonium chloride, ditallowdimethyl ammonium bromide (DTAB). Commercially available examples include, but are not limited to: ADOGEN®, ARQUAD®, TOMAH9®, VARIQUAT®.

In one embodiment, the fatty quat comprise the water-soluble quaternary ammonium compounds useful in the present invention having the formula (XV)

$$R_1R_2R_3R_4N^+X^- \quad \text{(XV)}$$

wherein $R_1$ of formula (XV) is $C_8$–$C_{16}$ alkyl, each of $R_2$, $R_3$ and $R_4$ of formula (XV) are independently $C_1$–$C_4$ alkyl, $C_1$–$C_4$ hydroxy alkyl, benzyl, and —$(C_2H_4O)_xH$ where x of formula (XV) has a value from 2 to 5, and X of formula (XV) is a anion selected from $Cl^-$, $Br^-$, methyl sulfate, formate, sulfate, nitrate, and mixtures thereof. Not more than one of $R_2$, $R_3$ or $R_4$ of formula (XV) should be selected as benzyl.

A preferred fatty quat embodiment has the formula (XVI):

$$(R)_{4-m}—N^+[(CH_2)_n—Y—R^2]_mX^- \quad \text{(XVI)}$$

wherein Y of formula (XVI) is selected from —O—(O)C— or —C(O)—O—; m of formula (XVI) is 2 or 3; n of formula (XVI) is from 1 to 4; R of formula (XVI) is selected from $C_{1-6}$, preferably $C_{1-3}$ alkyl group, benzyl, and mixtures thereof; $R^2$ is selected from $C_{11-21}$, substituted or unsubstituted hydrocarbonyl having at least partial unsaturated and its counterion $X^-$ of formula (XVI); $X^-$ of formula (XVI) is selected from $Cl^-$, $Br^-$, methyl sulfate, formate, sulfate, nitrate, and mixtures thereof. See U.S. Pat. No. 5,545,380.

Polar Solvent

Compositions according to the present invention may further comprise a polar solvent. Non-limiting examples of polar solvents include: water, alcohols, glycols, polyglycols, ethers, carbonates, dibasic esters, ketones, other oxygenated solvents, and mixtures thereof. Further examples of alcohols include: $C_1$–$C_{30}$ alcohols, such as propanol, ethanol, isopropyl alcohol, and the like, benzyl alcohol, and diols such as 1,2-hexanediol. The DOWANOL® series by Dow Chemical are examples of glycols and polyglycols useful in the present invention, such as DOWANOL® TPM, TPnP, DPnB, DPnP, TPnB, PPh, DPM, DPMA, DB, and others. Further examples include propylene glycol, butylene glycol, polybutylene glycol and more hydrophobic glycols. Examples of carbonate solvents are ethylene, propylene and butylene carbonantes such as those available under the JEFFSOL® tradename. Polar solvents for the present invention can be further identified through dispersive ($\delta_D$), polar ($\delta_P$) and hydrogen bonding ($\delta_H$) Hansen solubility parameters. Preferred polar solvents or polar solvent mixtures have fractional polar ($f_P$) and fractional hydrogen bonding ($f_H$) values of $f_P>0.02$ and $f_H>0.10$, where $f_P=\delta_P/(\delta_D+\delta_P+\delta_H)$ and $f_H=\delta_H/(\delta_D+\delta_P+\delta_H)$, more preferably $f_P>0.05$ and $f_H>0.20$, and most preferably $f_P>0.07$ and $f_H>0.03$.

In the consumable detergent composition of the present invention, the levels of polar solvent can be from 0 wt % to about 70 wt %, preferably about 1 wt % to about 50 wt % even more preferably about 1 wt % to about 30 wt % by weight of the consumable detergent composition.

In a preferred embodiment, the polar solvent comprises from about 0.1 wt % to about 1 wt %, preferably 0.5 wt % to about 1 wt %, by weight of the consumable detergent composition of water.

When the composition of the present invention comprises an amino-functional silicone as the only emulsifying agent, preferred levels of polar solvent are from about 0.01 wt % to about 2 wt %, preferably about 0.05 wt % to about 0.8 wt %, even more preferably about 0.1 wt % to about 0.5 wt % by weight of the consumable detergent composition.

When the consumable detergent composition of the present invention comprises higher levels of polar solvent, the detergents compositions preferably comprise from about 2 wt % to about 25 wt %, more preferably from about 5 wt % to about 20 wt %, even more preferably from about 8 wt % to about 15 wt % by weight of the consumable detergent composition.

Cleaning Adjuncts

The consumable detergent compositions of the present invention optionally further comprise at least one additional cleaning adjunct. The cleaning adjuncts can vary widely and can be used at widely ranging levels. For example, detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. Cleaning adjuncts that are catalytic, for example enzymes, can be used in "forward" or "reverse" modes, a discovery independently useful from the fabric treating methods of the present invention. For example, a lipolase or other hydrolase may be used, optionally in the presence of alcohols as cleaning adjuncts, to convert fatty acids to esters, thereby increasing their solubility in the lipophilic fluid. This is a "reverse" operation, in contrast with the normal use of this hydrolase in water to convert a less water-soluble fatty ester to a more water-soluble material. In any event, any cleaning adjunct must be suitable for use in combination with a lipophilic fluid in accordance with the present invention.

Some suitable cleaning adjuncts include, but are not limited to, builders, surfactants other than those described above with respect to the surfactant system, enzymes, bleach activators, bleach catalysts, bleach boosters, bleaches, alkalinity sources, antibacterial agents, colorants, perfumes, pro-perfumes, finishing aids, finishing polymers, lime soap dispersants, odor control agents, odor neutralizers, polymeric dye transfer inhibiting agents, crystal growth inhibitors, photobleaches, heavy metal ion sequestrants, anti-tarnishing agents, anti-microbial agents, anti-oxidants, anti-redeposition agents, soil release polymers, electrolytes, pH modifiers, thickeners, abrasives, divalent or trivalent ions, metal ion salts, enzyme stabilizers, corrosion inhibitors, diamines or polyamines and/or their alkoxylates, suds stabilizing polymers, solvents, process aids, fabric softening agents, optical brighteners, hydrotropes, suds or foam suppressors, suds or foam boosters and mixtures thereof.

Optionally, the consumable detergent compositions useful for the present invention may comprise processing aids. Processing aids facilitate the formation of the consumable detergent compositions by maintaining the fluidity and/or homogeneity of the consumable detergent composition, and/or aiding in the dilution process. Processing aids suitable for the present invention are solvents, preferably solvents other than those described above, hydrotropes, and/or surfactants, preferably surfactants other than those described above with respect to the surfactant system. Particularly preferred processing aids are protic solvents such as aliphatic alcohols, diols, triols, etc. and nonionic surfactants such as ethoxylated fatty alcohols.

Processing aids, when present in the consumable detergent compositions, preferably comprise from about 0.02 wt % to about 10 wt %, more preferably from about 0.05 wt % to about 10 wt %, even more preferably from about 0.1 wt % to about 10 wt % by weight of the consumable detergent composition. Processing aids, when present in the consumable detergent compositions, preferably comprise from about 1 wt % to about 75 wt %, more preferably from about 5 wt % to about 50 wt % by weight of the consumable detergent composition.

Suitable odor control agents, which may optionally be used as finishing agents, include agents include, cyclodextrins, odor neutralizers, odor blockers and mixtures thereof. Suitable odor neutralizers include aldehydes, flavanoids, metallic salts, water-soluble polymers, zeolites, activated carbon and mixtures thereof.

Perfumes and perfumery ingredients useful in the consumable detergent compositions for the present invention comprise a wide variety of natural and synthetic chemical ingredients, including, but not limited to, aldehydes, ketones, esters, and the like. Also included are various natural extracts and essences which can comprise complex mixtures of ingredients, such as orange oil, lemon oil, rose extract, lavender, musk, patchouli, balsamic essence, sandalwood oil, pine oil, cedar, and the like. Finished perfumes may comprise extremely complex mixtures of such ingredients. Pro-perfumes are also useful in the present invention. Such materials are those precursors or mixtures thereof capable of chemically reacting, e.g., by hydrolysis, to release a perfume.

Bleaches, especially oxygen bleaches, are another type of laundry additive suitable for use in the consumable detergent compositions for the present invention. This is especially the case for the activated and catalyzed forms with such bleach activators as nonanoyloxybenzenesulfonate and/or any of its linear or branched higher or lower homologs, and/or tetraacetylethylenediamine and/or any of its derivatives or derivatives of phthaloylimidoperoxycaproic acid (PAP; available from Ausimont SpA under trademane EUROCO®) or other imido- or amido-substituted bleach activators including the lactam types, or more generally any mixture of hydrophilic and/or hydrophobic bleach activators (especially acyl derivatives including those of the $C_6$–$C_{16}$ substituted oxybenzenesulfonates).

Also suitable are organic or inorganic peracids both including PAP and other than PAP. Suitable organic or inorganic peracids for use herein include, but are not limited to: percarboxylic acids and salts; percarbonic acids and salts; perimidic acids and salts; peroxymonosulfuric acids and salts; persulphates such as monopersulfate; peroxyacids such as diperoxydodecandioic acid (DPDA); magnesium peroxyphthalic acid; perlauric acid; perbenzoic and alkylperbenzoic acids; and mixtures thereof.

Detersive enzymes such as proteases, amylases, cellulases, lipases and the like as well as bleach catalysts including the macrocyclic types having manganese or similar transition metals all useful in laundry and cleaning products can be used herein at very low, or less commonly, higher levels. For example, a lipolase or other hydrolase may be used, optionally in the presence of alcohols as laundry additives, to convert fatty acids to esters, thereby increasing their solubility in the lipohilic fluid.

Nonlimiting examples of finishing polymers that are commercially available are: polyvinylpyrrolidone/dimethylaminoethyl methacrylate copolymer, such as Copolymer 958®, weight average molecular weight of about 100,000 daltons and Copolymer 937®, weight average molecular weight of about 1,000,000 daltons, available from GAF Chemicals Corporation; adipic acid/dimethylaminohydroxypropyl diethylenetriamine copolymer, such as CARTARETIN F-4® and F-23®, available from Sandoz Chemicals Corporation; methacryloyl ethyl betaine/methacrylates copolymer, such as DIAFORMER Z-SM®, available from Mitsubishi Chemicals Corporation; polyvinyl alcohol copolymer resin, such as VINEX 2019®, available from Air Products and Chemicals or MOWEO1®, available from Clariant; adipic acid/epoxypropyl diethylenetriamine copolymer, such as DELSETTE 101®, available from Hercules Incorporated; polyamine resins, such as CYPRO 515®, available from Cytec Industries; polyquaternary amine resins, such as KYMENE 557H ®, available from Hercules Incorporated; and polyvinylpyrrolidone/acrylic acid, such as SOKALAN EG 310®, available from BASF.

The cleaning additive may also be an antistatic agent. Any suitable well-known antistatic agents used in conventional laundering and dry cleaning are suitable for use in the consumable detergent compositions and methods of the present invention. Especially suitable as antistatic agents are the subset of fabric softeners which are known to provide antistatic benefits. For example those fabric softeners that have a fatty acyl group which has an iodine value of above 20, such as N,N-di(tallowoyl-oxy-ethyl)-N,N-dimethyl ammonium methylsulfate. However, it is to be understood that the term antistatic agent is not to be limited to just this subset of fabric softeners and includes all antistatic agents.

Preferred insect and moth repellent laundry additives useful in the compositions of the present invention are perfume ingredients, such as citronellol, citronellal, citral, linalool, cedar extract, geranium oil, sandalwood oil, 2-(diethylphenoxy)ethanol, 1-dodecene, etc. Other examples of insect and/or moth repellents useful in the compositions of the present invention are disclosed in U.S. Pat. Nos. 4,449,987; 4,693,890; 4,696,676; 4,933,371; 5,030,660; 5,196,200; and in "Semio Activity of Flavor and Fragrance Molecules on Various Insect Species", B.D. Mookherjee et al., published in *Bioactive Volatile Compounds from Plants*, ACS Symposium Series 525, R. Teranishi, R. G. Buttery, and H. Sugisawa, 1993, pp. 35–48.

Method of Cleaning

The surfactant system and the consumable detergent composition may be utilized to clean fabric articles in a non-aqueous solvent based washing system utilizing lipophilic fluid. The method includes the step of contacting a cleaning solution, comprising the surfactant system or the consumable detergent composition of the present invention and a lipophilic fluid, with a fabric article and then extracting the cleaning solution from the fabric article. The method may further comprise a pre-step of mixing the surfactant system or the consumable detergent composition with a lipophilic fluid to form a cleaning solution. The method may further comprise the steps of agitating the fabric article in the cleaning solution; scrubbing the fabric article; drying the fabric article and any combination thereof. The drying step may include heat drying, air drying, or any other known form of drying a fabric article.

EXAMPLES

| | example #1 wt % | example #2 wt % | example #3 wt % | example #4 wt % | example #5 wt % |
|---|---|---|---|---|---|
| Alkyloxypolyethyleneoxyethanol[1] | 25.0 | 29.6 | 27.5 | 0.0 | 0.0 |
| Sodium bis(tridecyl)sulfosuccinate[2] | 0.0 | 0.0 | 0.0 | 25.0 | 0.0 |
| Alkane diol[3] | 25.0 | 25.0 | 25.0 | 25.0 | 50.0 |
| Oleic Acid | 20.0 | 20.0 | 20.0 | 20.0 | 20.0 |
| Propylene Glycol | 15.4 | 15.4 | 15.4 | 15.4 | 15.4 |
| Alkyl Succinate Quat | 0.0 | 0.0 | 0.0 | 0.0 | 0.0 |
| Dipalmithyl hydroxyethylammonium methylsulfate (unsaturated)[4] | 4.6 | 0.0 | 4.6 | 4.6 | 4.6 |
| Amino functional polysiloxane[5] | 2.5 | 2.5 | 0.0 | 2.5 | 2.5 |
| Dimethyl hydroxypropyl methyl siloxane (ethoxylated)[6] | 7.5 | 7.5 | 7.5 | 7.5 | 7.5 |
| Water | 0.0 | 0.0 | 0.0 | 0.0 | 0.0 |
| Total | 100.0 | 100.0 | 100.0 | 100.0 | 100.0 |

[1]TERGITOL 15-S-3 ® - available from Dow (Union Carbide Corporation)
[2]AEROSOL TR ® 70% - available from CYTEX.
[3]ENVIROGEM AD01 ® - available from Air Products
[4]See U.S. Pat. No. 5,545,340
[5]XS-69B5476 - available from General Electric
[6]TSF4446 - available from General Electric

| | example #6 wt % | example #7 wt % | example #8 wt % | example #9 wt % | example #10 wt % | example #11 wt % | example #12 wt % |
|---|---|---|---|---|---|---|---|
| Alkyloxypolyethyleneoxy ethanol[1] | 25.0 | 20.00 | 18.00 | 40.00 | 50.00 | 59.00 | 59.00 |
| Sodium bis(tridecyl)sulfosuccinate[2] | 25.0 | 0.0 | 0.0 | 0.0 | 0.0 | 0.0 | 0.0 |
| Alkane diol[3] | 4.6 | 20.00 | 18.00 | 0.0 | 0.0 | 0.0 | 0.0 |
| Oleic Acid | 20.0 | 20.00 | 20.00 | 20.00 | 20.00 | 0.0 | 0.0 |
| Propylene Glycol | 15.4 | 15.60 | 14.60 | 15.60 | 20.00 | 12.00 | 12.00 |
| Alkyl Succinate Quat | 0.0 | 0.0 | 5.00 | 0.0 | 0.0 | 0.0 | 0.0 |
| Dipalmithyl hydroxyethylammonium methylsulfate (unsaturated)[4] | 0.0 | 0.0 | 0.0 | 0.0 | 0.0 | 4.00 | 4.00 |
| bis-2-ethylhexylphosphate dicocomethyl ammonium salt | 0.0 | 0.0 | 0.0 | 0.0 | 0.0 | 15.00 | 0.0 |

-continued

| | | | | | | | |
|---|---|---|---|---|---|---|---|
| 2-[(2E)-hexadec-2-en-1-yl] succinate mono (2-ethylhexyl) esterdicocomethyl ammonium salt | 0.0 | 0.0 | 0.0 | 0.0 | 0.0 | 0.0 | 15.00 |
| Amino functional polysiloxane[5] | 2.5 | 2.50 | 2.50 | 2.50 | 2.50 | 0.0 | 0.0 |
| Dimethyl hydroxypropyl methyl siloxane (ethoxylated)[6] | 7.5 | 7.5 | 7.5 | 7.5 | 7.5 | 10.00 | 10.00 |
| Water | 0.0 | 14.40 | 14.40 | 14.40 | 0.0 | 0.0 | 0.0 |
| Total | 100.0 | 100.0 | 100.0 | 100.0 | 100.0 | 100.0 | 100.0 |

[1]TERGITOL 15-S-3 ® - available from Dow (Union Carbide Corporation)
[2]AEROSOL TR ® 70% - available from CYTEX.
[3]ENVIROGEM AD01 ® - available from Air Products
[4]See U.S. Pat. No. 5,545,340
[5]XS-69B5476 - available from General Electric
[6]TSF4446 - available from General Electric

| | example #11 wt % | example #12 wt % | example #13 wt % | example #14 wt % | example #15 wt % | example #16 wt % | example #17 wt % |
|---|---|---|---|---|---|---|---|
| Alkyloxypolyethyleneoxy ethanol[1] | 65.0 | 50.0 | 62.5 | 47.5 | 50.0 | 52.5 | 57.5 |
| Anionic Surfactant | 10.0 | 0.0 | 5.0 | 2.5 | 0.0 | 5.0 | 10.0 |
| Fatty acid and/or fatty acid salt | 0.0 | 10.0 | 5.0 | 2.5 | 5.0 | 0.0 | 5.0 |
| Propylene Glycol | 15.0 | 15.0 | 15.0 | 20.0 | 20.0 | 20.0 | 10.0 |
| Amino functional polysiloxane[5] | 0.0 | 0.0 | 2.5 | 2.5 | 2.5 | 2.5 | 2.5 |
| Dimethyl hydroxypropyl methyl siloxane (ethoxylated)[6] | 10.0 | 10.0 | 10.0 | 10.0 | 10.0 | 10.0 | 10.0 |
| Water | 0.0 | 15.0 | 0.0 | 15.0 | 12.5 | 10.0 | 5.0 |
| Total | 100.0 | 100.0 | 100.0 | 100.0 | 100.0 | 100.0 | 100.0 |

[1]TERGITOL 15-S-3 ® - available from Dow (Union Carbide Corporation)
[2]AEROSOL TR ® 70% - available from CYTEX.
[3]ENVIROGEM AD01 ® - available from Air Products
[4]See U.S. Pat. No. 5,545,340
[5]XS-69B5476 - available from General Electric
[6]TSF4446 - available from General Electric

| | example #18 wt % | example #19 wt % | example #20 wt % | example #21 wt % |
|---|---|---|---|---|
| Alkyloxypolyethyleneoxy ethanol[1] | 59.00 | 59.00 | 59.00 | 59.00 |
| Propylene Glycol | 12.00 | 12.00 | 12.00 | 12.00 |
| Dipalmithyl hydroxyethylammonium methylsulfate (unsaturated)[2] | 4.00 | 4.00 | 4.0 | 0.0 |
| 2-[(2E)-oct-2-en-1-yl] succinic acid monobutyl ester | 0.0 | 0.0 | 0.0 | 9.00 |
| bis-2-ethylhexylphosphate dicocomethyl ammonium salt | 15.00 | 0.0 | 0.0 | 0.0 |
| 2-[(2E)-hexadec-2-en-1-yl] succinate mono (2-ethylhexyl) esterdicocomethyl ammonium salt | 0.0 | 15.00 | 0.0 | 0.0 |
| 2-[(2E)-oct-2-en-1-yl] succinate monobutyl ester dicocomethyl ammonium salt | 0.0 | 0.0 | 15.00 | 10.00 |
| Dimethyl hydroxypropyl methyl siloxane (ethoxylated)[3] | 10.00 | 10.00 | 10.00 | 10.00 |
| Water | 0.0 | 0.0 | 0.0 | 0.0 |
| Total | 100 | 100 | 100 | 100 |

[1]TERGITOL 15-S-3 ® - available from Dow (Union Carbide Corporation)
[2]See U.S. Pat. No. 5,545,340
[3]TSF4446 - available from General Electric While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited are, in relevant part, incorporated herein by reference; the citation of any document is not to be construed as an admission that it is prior art with respect to the present invention.

What is claimed is:

1. A lipophilic fluid-based cleaning solution comprising a lipophilic fluid and a consumable detergent composition, said detergent composition comprising:

a) from about 0.1% to about 50% by weight of the composition of a silicone surfactant;

b) from about 0.1% to about 85% by weight of the composition of an additional nonionic surfactant;

c) from about 10% to about 45% by weight of the composition of a gemini surfactant;

d) from about 0.1% to about 50% by weight of the composition of a polar solvent; and e) from about 5% to about 40% by weight of the composition of a fatty acid, a fatty acid salt, or mixtures thereof.

2. The cleaning solution according to claim 1, wherein the lipophilic fluid is selected from the group consisting of siloxanes, hydrocarbons, glycol ethers, glycerin ethers, perfluorinated amines, perfluorinated and hydrofluoroether solvents, and mixtures thereof.

3. The cleaning solution according to claim 2 wherein the lipophilic fluid is liner or cyclic siloxanes.

* * * * *

UNITED STATES PATENT AND TRADEMARK OFFICE

CERTIFICATE OF CORRECTION

PATENT NO. : 7,202,202 B2
APPLICATION NO. : 10/873976
DATED : April 10, 2007
INVENTOR(S) : Haeggberg et al.

It is certified that error appears in the above-identified patent and that said Letters Patent is hereby corrected as shown below:

Column 4

Line 3, after "$C_6Q_4$", insert -- of formula --.

Column 22

Line 5, delete "liner" and insert -- linear --.

Signed and Sealed this

Tenth Day of July, 2007

JON W. DUDAS
*Director of the United States Patent and Trademark Office*